US007393182B2

(12) United States Patent
Matheny

(10) Patent No.: US 7,393,182 B2
(45) Date of Patent: Jul. 1, 2008

(54) COMPOSITE TIP SHROUD RING

(75) Inventor: Alfred Paul Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 23 days.

(21) Appl. No.: 11/185,339

(22) Filed: Jul. 20, 2005

(65) Prior Publication Data

US 2007/0086889 A1 Apr. 19, 2007

Related U.S. Application Data

(60) Provisional application No. 60/677,898, filed on May 5, 2005.

(51) Int. Cl.
*F01D 5/22* (2006.01)

(52) U.S. Cl. ..... 416/181; 416/190; 416/228

(58) Field of Classification Search ..... 415/134, 415/136, 138, 228, 173.6; 416/181, 228, 416/190, 189

See application file for complete search history.

(56) References Cited

U.S. PATENT DOCUMENTS 4,017,209 A 4/1977 Bodman
4,232,996 A 11/1980 Stoffer
5,037,273 A * 8/1991 Krueger et al. ..... 416/190
5,253,978 A * 10/1993 Fraser ..... 416/190
6,402,474 B1 * 6/2002 Okuno ..... 416/190

* cited by examiner

*Primary Examiner*—Richard A. Edgar
(74) *Attorney, Agent, or Firm*—John Ryznic

(57) ABSTRACT

A gas turbine engine includes a tip shroud ring rotatably supported on a last stage blade assembly in a turbine. The tip shroud ring is formed entirely of a fiber reinforced ceramic matrix composite material to provide a very light weight tip shroud ring, but also a very strong ring. The blades include pins extending from the tips, and the tip shroud ring includes holes in which the pins slide. Thus, the tip shroud ring is completely supported by the blade tip pins, and the centrifugal force developed by the rotation of the tip shroud ring does not add to the tensile force developed along the blades. Thus, the maximum rotational speed of the turbine rotor as defined by $An^2$ can be increased. Also, because the blade tips are secured to the tip shroud ring in a circumferential direction, the tip shroud ring acts to dampen the bladed turbine by allowing only the middle of the blade to vibrate.

8 Claims, 1 Drawing Sheet

COMPOSITE TIP SHROUD RING

CROSS-REFERENCE TO RELATED APPLICATIONS

This application claims the benefit of a prior filed and U.S. Provisional Application, Ser. No. 60/677,898 filed on May 5, 2005 and entitled Composite Tip Shroud Ring.

BACKGROUND OF THE INVENTION

1. Field of the Invention

This Invention relates to the field of Gas Turbine Engines, and, more specifically, to an annular tip shroud for a full row of rotating turbine blades.

2. Description of the Related Art

Rotating blades in a gas turbine engine are known to include tip shrouds to provide a gas seal for the flow path through the turbine, to provide a change in vibration response, and to provide vibration damping of the blades. A tip shroud will add mass to the blade, which will increase the pull and airfoil stress of the specific blade. A designer typically will use the tip shroud for a set of blades in a particular row to control the modal frequency of the blade such that the natural frequency of the blade will not coincide with a driving frequency of the gas turbine engine. This matching of frequencies could produce resonant vibration in the blade, which can cause damage to the blade. Also, the size of the shroud will increase the stress in the blade and require the rotor disc to be larger in order to carry the increased load.

The last stage of the turbine has blades with the largest diameters. In order to extract the largest amount of power from the flowing gases, it is preferable to provide the last stage of the turbine with the largest diameter of blades possible. The power extracted from the last stage of the turbine is related to the equation $An^2$, where A is the circumferential area of the rotational plane of the blade diameter and N is the rotational speed of the turbine. The larger the value of $An^2$ the larger the amount of power the last stage of the turbine can extract from the flowing gases.

However, as the blade diameter increases, the centrifugal force acting on the blade increase, this force being larger with the addition of tip shrouds on the blades. Thus, the blade diameter—and, therefore, the power extracted from the flowing gases—is limited to the resulting stresses in which the blade is capable of withstanding.

U.S. Pat. No. 5,037,273 issued to Kreuger et al on Aug. 6, 1991 shows a compressor impeller with a ring shaped shroud band which is mounted at blade tips, each blade tip being enclosed in an identical radially slidable manner by a guide block, and the guide blocks being fastened to the shroud band. In the Kreuger et al invention, the blade tip slides within a closed opening in the shroud ring assembly, and the shroud ring assembly is made up of fiber reinforced and metal materials. The shroud tip assembly is relatively heavy and therefore would limit the rotational speed of the rotor and blades to a lower speed than the present invention.

Thus, there is a need to improve the sealing between blades by including a tip shroud, and to increase the diameter of the blades in the last stage of the turbine in order to extract the greatest amount of power from the flowing gases while also improving the vibration damping characteristics of the shroud ring.

BRIEF SUMMARY OF THE INVENTION

The object of the present invention is to provide a tip shroud ring on a row of turbine blades that will provide an improved seal between adjacent blades as well as reducing the mass of the tip shrouds in order to allow for a larger diameter of turbine blades. This objection is accomplished by proving a tip shroud ring that is completely annular in shape (360 degrees) and is formed from fiber reinforced ceramic composites. This ring is strong enough to carry its own weight (below its self-containing radius, or maximum radius at which a certain mass will break under the centrifugal force due to rotation). The annular tip shroud ring is held in place on the blades by pins extending from the tip of each blade in a radial direction. The pins extend through holes in the tip shroud ring, enabling the tip shroud ring to move in a radial direction of the blades to allow for thermal growth in the blades. The solid shroud ring improves the damping ability of the rigidly attaching the blade tips together along the circumferential direction, while allowing the blade tips to slide in the radial direction with respect to the shroud ring in order to prevent the mass of the shroud ring from increasing the tensile force acting on the blades.

DETAILED DESCRIPTION OF THE INVENTION

Figure 2:
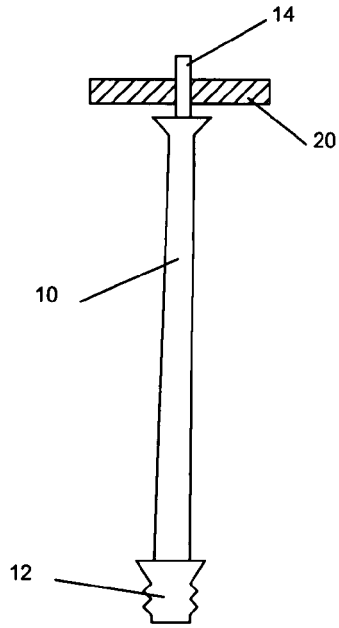
FIG. 2 shows a side view of the blade and tip shroud ring of the present invention offset 90 degrees from the view shown in FIG. 1.
Figure 3:
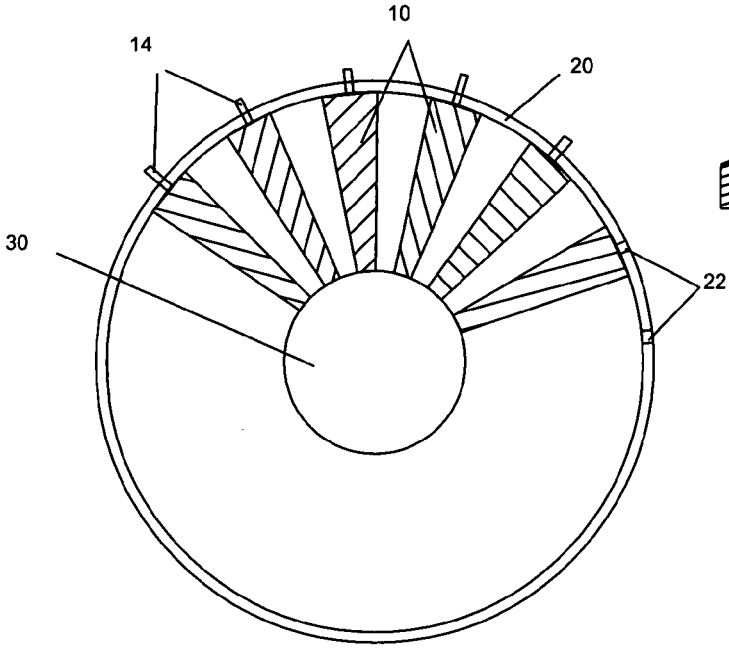
FIG. 3 shows a turbine rotor disc of the present invention having a plurality of blades extending radial outward there from, and the entire tip shroud ring encircling the plurality of blades and engaging the blades through the pins and the holes in the ring.
Figure 4:
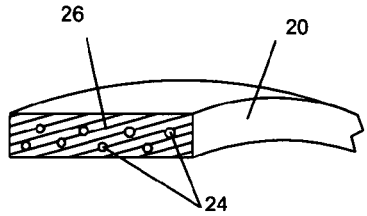
FIG. 4 shows a cross section of the ring 20 of the present invention in which the fibers 24 are shown extending in the circumferential direction.

As shown in FIG. 3, a rotor includes a rotor disc 30 with slots extending around the circumference of the rotor disc 30. A plurality of turbine blades 10 extends from the rotor disc 30 outward. FIG. 3 shows only 6 of the blades in a 90 degree sweep of the rotor disc, but in actuality will extend the full 360 degrees around the rotor disc. The turbine blades 10 each include a root 12 (FIGS. 1 and 2) having a well-known fir tree configuration. The root 12 of each blade 10 slides within the slot of the rotor disc 30, and is held in place by any of the well known retaining means of the prior art. Each blade 10 includes two pins 14 extending from the tip end of the blade 10.

Figure 1:
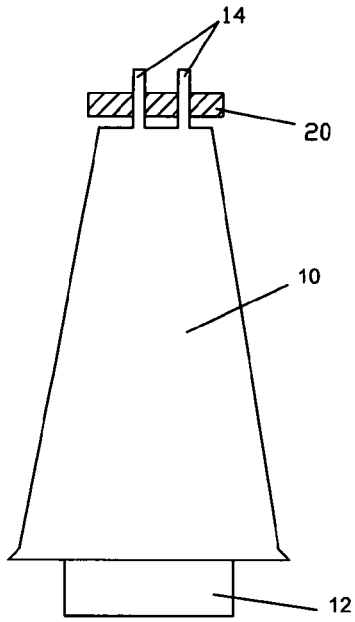
FIG. 1 shows a turbine blade 10 with pins on the tip end, and the tip shroud ring 20 of the present invention extending around the blade tip.

The inventive concept of this invention is shown in FIG. 1 and includes a tip shroud ring 20 formed as a single annular ring of a full 360 degrees. The ring 20 includes holes 22 therein positioned to accept the pins 14 of the blades. The holes 22 in the ring are sized such that the pins 14 of the blade can slide freely without much frictional restriction, yet tight enough to provide a well sealed space between pin and hole to minimize gas leakage.

The tip shroud ring 20 is made of a fiber-reinforced ceramic matrix material in order to provide high strength and low weight. This will allow for the blades in the last stage of the turbine to obtain a radial dimension larger than that in the prior art, and therefore an increase in the power extracted from the flowing gases. The term ceramic matrix composite is used herein to include any fiber-reinforced ceramic matrix material as may be known or may be developed in the art of structural ceramic materials. The fibers 24 and the matrix material 26 surrounding the fibers may be oxide ceramics or non-oxide ceramics or any combination thereof. A wide range of ceramic matrix composites (CMCs) have been developed that combine a matrix material with a reinforcing phase of a different composition (such as mulite/silica) or of the same composition (alumina/alumina or silicon carbide/silicon carbide). The fibers may be continuous or long discontinuous fibers. The matrix may further contain whiskers, platelets or particulates. Reinforcing fibers may be disposed in the matrix material in layers, with the plies of adjacent layers being directionally oriented to achieve a desired mechanical strength. The fibers are oriented in the hoop direction of the ring (along the circumferential direction) in order to provide for the high strength of the ring along the circumferential direction. The ring could also be a fiber bundle with adequate stitching to be free of matrix material.

Ceramic and ceramic matrix composite (CMC) materials offer the potential for higher operating temperatures than do metal alloy materials due to the inherent nature of ceramic materials. This capability may be translated into a reduced cooling requirement that, in turn, may result in higher power, greater efficiency, and/or reduced emissions from the machine. High temperature insulation for ceramic matrix composites has been described in U.S. Pat. No. 6,197,424 B1, which issued on Mar. 6, 2001, and is incorporated herein by reference. That patent describes an oxide-based insulation system for a ceramic matrix composite substrate that is dimensionally and chemically stable at a temperature of approximately 1600.degree. C.

The shroud tip ring is sized such that the diameter will allow for the blade tip—when assembled into the disc and the ring—to have a gap space between the outer tip of the blade and the inner surface of the ring at the cold state. When the turbine is operating at steady state, the blades will grow in length along the radial direction. Since the ring is made of a fiber-reinforced ceramic matrix material, the coefficient of thermal expansion of the ring will be much less than the coefficient of thermal expansion of the blade. It is desirable to size the ring such that the gap between the blade tip and the inner surface of the ring will be very small during the steady state operation such that the leakage of the flowing gases is minimized.

Since the tip shroud ring is made of a high temperature material, no cooling is required for the ring. Also, since the tip shroud ring is annular, the blades must be inserted into the ring before the blades are inserted into the slots of the rotor disc. the assembly of the rotor is as follows: the blades are inserted into the tip shroud ring; then, the blade/tip shroud ring assembly is inserted into the slots of the rotor disc. the entire rotor disc assembly with blades and tip shroud ring is then inserted into the turbine engine.

The present invention provides several advantages over the known prior art devices. Since the tip shroud ring 20 is made of a solid, ceramic composite material, the tip shroud ring 20 is very strong but also very light in weight compared to other prior art tip shroud rings. The turbine can operate at a higher rotational speed because the lighter and stronger tip shroud ring of the present invention increases the allowable $An^2$ speed. Also, because the tip shroud ring includes holes for the blade tip pins to slide therein, the weight of the tip shroud ring does not add to the centrifugal force acting along the blade. This also provides for an improvement in the $An^2$ speed of the rotor assembly. In addition, since the tip shroud ring is a solid ring and the blade tip pins slide within holes of the tip shroud ring, the circumferential spacing of the blade tips remain constant, and as a result only higher orders of vibrations occur in the blade. The first order of vibration would occur when the middle of the blade would vibrate. Thus, the lower orders of vibrations on the Campbell chart would be dampened by the tip shroud ring of the present invention. Since the tip shroud ring 20 is made of the ceramic matrix composite material, a higher temperature can be exposed to the blade tips, and no cooling of the tip shroud ring is required.

I claim the following:

1. A rotor assembly for a gas turbine engine, the rotor assembly having a rotor disc with a plurality of turbine blades extending there from, and a tip shroud ring rotatably secured to the blade tips, the rotor assembly comprising:

The blade tips each including at least one pin extending in a radial direction;

An annular shroud ring formed as a single piece and having at least one hole for each pin extending from the plurality of blade tips; and, The pins and the holes securing the annular shroud ring against relative circumferential displacement to the blade tips while allowing for radial displacement so that a centrifugal force developed by the rotation of the tip shroud ring does not add to the tensile force developed along the blades.

2. The rotor assembly of claim 1, and further comprising:

The annular shroud ring being formed substantially from a ceramic matrix composite material with fibers extending along the circumferential direction of the shroud ring.

3. The rotor assembly of claim 2, and further comprising:

The ceramic matrix composite annular shroud ring is located on the last stage of the turbine.

4. The rotor assembly of claim 1, and further comprising:

Each blade tip includes two pins; and,

The annular shroud ring includes two holes for each blade.

5. The rotor assembly of claim 1, and further comprising:

The blade pins and the shroud ring holes allow for radial displacement of the annular shroud ring with respect to the blade tip pins.

6. A rotor assembly for a gas turbine engine comprising:

A plurality of turbine blades extending from a rotor disk;

An annular shroud ring rotatably connected to the turbine blades; and,

Blade tip to shroud ring connecting means to rotatably secure the shroud ring to the blade tips in the circumferential direction while allowing for the annular ring be displaced in the radial direction with respect to the blade tip during rotation of the rotor assembly.

7. The rotor assembly for a gas turbine engine of claim 6, and further comprising:

The annular shroud ring being formed substantially from a ceramic matrix composite material with fibers extending along the circumferential direction of the shroud ring.

8. The rotor assembly for a gas turbine engine of claim 7, and further comprising:

The ceramic matrix composite annular shroud ring is located on the last stage of the turbine.

* * * * *